United States Patent [19]

Beesley et al.

[11] Patent Number: 4,579,053

[45] Date of Patent: Apr. 1, 1986

[54] WASTE TRANSFER PACKERS

[75] Inventors: Brian G. Beesley, Dawlish; Clive Hurley, Woodbury; Ramon H. J. Brend; Robert W. D. Sherrell, both of Exeter; Thomas P. Edwards, Chudleigh Knighton; Andrew J. Vickery, Newton Abbot, all of England

[73] Assignee: Devon County Council, Exeter, England

[21] Appl. No.: 674,480

[22] Filed: Nov. 23, 1984

Related U.S. Application Data

[63] Continuation of Ser. No. 436,441, Oct. 25, 1982, abandoned.

[30] Foreign Application Priority Data

Oct. 24, 1981 [GB] United Kingdom ..... 8132122
Oct. 1, 1982 [GB] United Kingdom ..... 8228126

[51] Int. Cl.[4] ..... B30B 15/00

[52] U.S. Cl. ..... 100/229 A; 49/371; 100/190

[58] Field of Search ..... 100/41, 66, 141, 142, 100/190, 229 A; 49/371, 366; 160/117, 206; 220/337

[56] References Cited

U.S. PATENT DOCUMENTS

| | | | |
|---|---|---|---|
| 760,117 | 5/1904 | Hayes | 100/190 X |
| 1,090,562 | 3/1914 | Orr et al. | 160/117 |
| 2,622,748 | 12/1952 | Feidert | 100/190 X |
| 2,961,105 | 11/1960 | Shubin | 100/229 A |
| 3,059,789 | 10/1962 | Bowles | 100/229 A |
| 3,230,868 | 1/1966 | Smith | 100/229 R X |
| 3,962,965 | 6/1976 | Corompt | 100/229 A X |
| 4,044,664 | 8/1977 | Budoff | 100/229 A X |

FOREIGN PATENT DOCUMENTS

| | | | |
|---|---|---|---|
| 144063 | 11/1979 | Japan | 100/229 A |

*Primary Examiner*—Billy J. Wilhite
*Attorney, Agent, or Firm*—Fleit, Jacobson, Cohn & Price

[57] ABSTRACT

Loading doors for a container such as a transfer container for domestic waste which cooperates with a compactor loader having a horizontally reciprocating ram comprise a plurality of flaps which effectively close an opening sized to correspond with a spigot of the compactor loader the doors being opened by mechanical connection with a part of the compactor loader and resulting from relative movement between it and the door.

10 Claims, 13 Drawing Figures

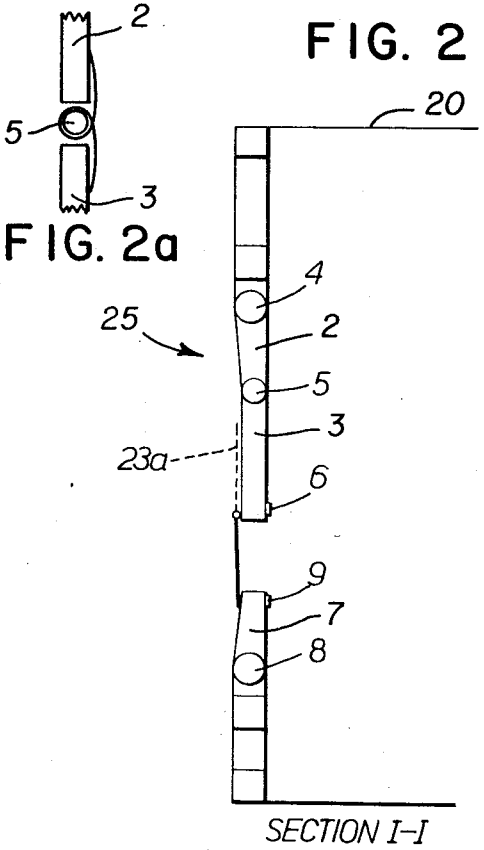
FIG. 2
FIG. 2a
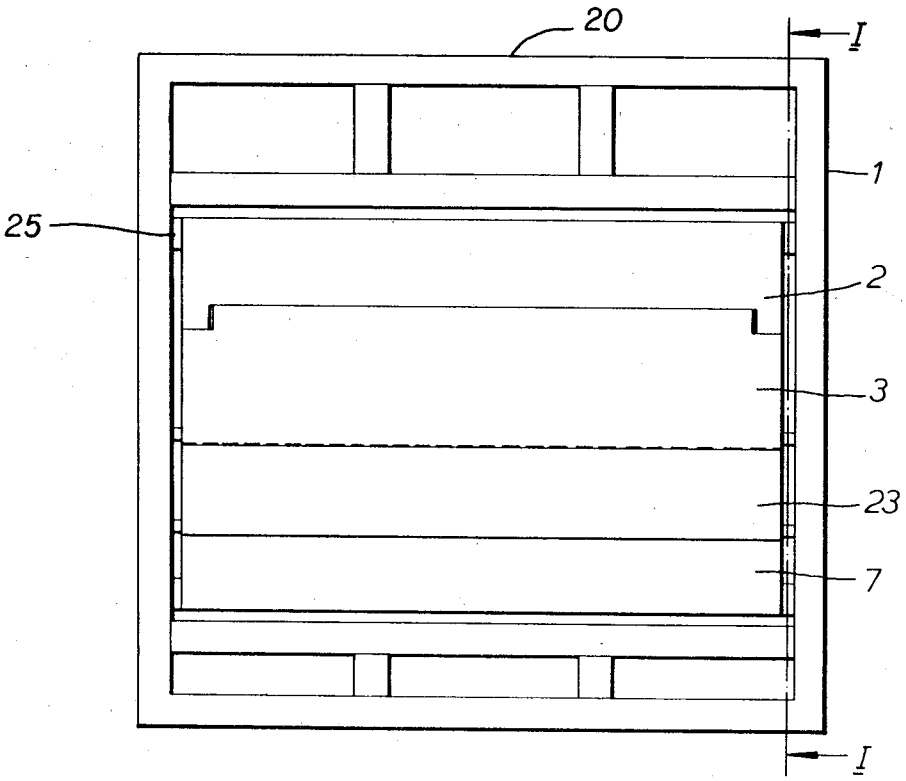
FIG. 1

WASTE TRANSFER PACKERS

This application is a continuation of application Ser. No. 436,441, filed Oct. 25, 1982, now abandoned.

This invention relates to the transfer of bulk compacted loose material, such as domestic waste. Such material is commonly delivered at a collecting point such as a transfer station or a comminuting plant where it is delivered into a hopper of a compactor loader (hereinafter referred to as a packer). A packer typically has a horizontal reciprocating ram operating to deliver compacted material through a spigot into a receiver which may be a transfer container for use, for example, on a road vehicle. The usual arrangement on such a container is to have a rear door which closes the aperture in the rear end of the container and which is opened for loading and closed for transit and opened again for discharge. The use of such a rear door, particularly when attempts are made to maximise the load the container can carry, frequently occasion considerable amounts of spillage when the container is removed from the spigot of the packer. This, in turn, involves appreciable labour costs in clearing the spillage, quite apart from its nuisance value. The present invention aims to reduce these problems, while tending to maximise the load that can be transferred, and at the same time reducing the labour content of the normal operation.

According to one aspect of the invention a loading door for cooperation with a horizontally acting reciprocating packer for loose material such as domestic waste has a frame with at least one upper and at least one lower closure formed of hinged flaps arranged to close between them an opening sized to correspond with the spigot of the packer, the flaps being arranged for opening by mechanical connection with a part of the packer and as a result of relative movement of the door frame and the packer.

The door of the invention may be applied to a vehicle body or to a transfer container which may be suitable for transport by a vehicle or by other means. The door may be part of a discharge closure for the container or it may be separate therefrom in a different wall of the container depending on the delivery and transfer arrangements that are in use. A system that is in wide use at the present time, however, involves transfer containers for vehicles that are unloaded from the vehicle and offered up on guides to the packer so that the spigot of the packer enters the rear of the container the discharge door at the rear having been opened manually for this purpose. Where the door of the invention has been fitted to the discharge door of such a container, the container may then be offered up to the spigot of the packer and the closures of the door opened automatically by movement against the packer or the spigot. The power for this movement may be derived from the vehicle itself simply by causing it to push against the container.

The lower part of the door may consist of a flap which is hinged about its lower horizontal edge in a case where the projection of the spigot is less than half the height of the opening. The flap may then be made equal to the spigot projection and be covered by the bottom face of the spigot when loading is taking place. The invention also contemplates the provision of a special spigot in which the bottom face is extended so that a deeper flap can be used to effectively close, for example, up to half of the door opening. In this way, if desired, a pair of vertically hinged flaps could be used in the lower position, provided the sides of the spigot are also extended to cover the surfaces of these flaps.

The upper part of the door opening is preferably closed by a horizontally hinged flap to which other subsidiary flaps may be articulated to close at least the major part of the door opening when in the closed position. The flaps are preferably spring loaded so as to take up a position normally providing a closure for the door opening. Since, however, the material being loaded in inserted by means of the ram through a hollow spigot a small gap between the upper and lower flaps is usually acceptable for purposes of transit within a given site. However, for road transport purpose, in order to comply with regulations it may be necessary to fit an auxiliary flap which completes the closure.

Several forms of the invention will now be described by way of example in connection with the accompanying drawings in which:

FIG. 1 is an end elevation of a container and

FIG. 2 is a section thereof on the line I—I,

Figure 8:
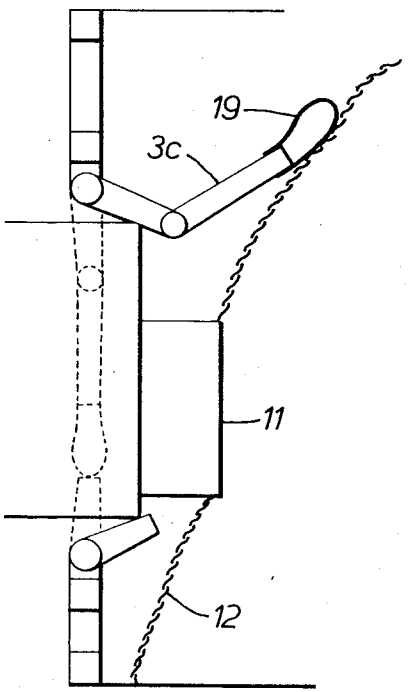
Figure 7:
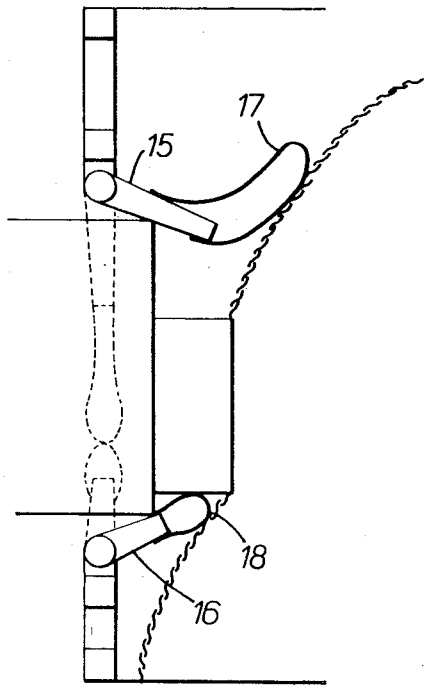
Figure 6:
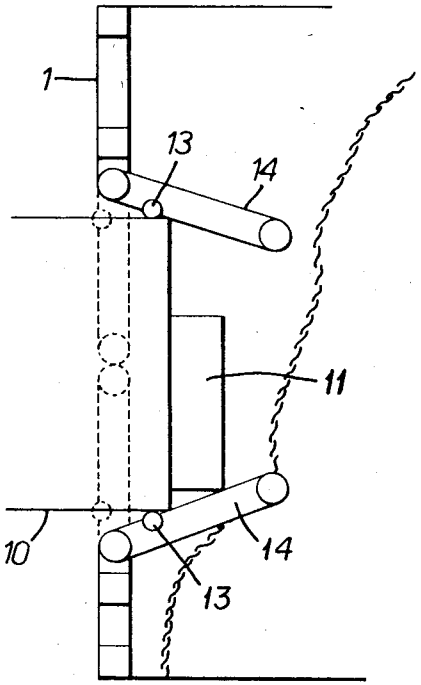
Figure 9:
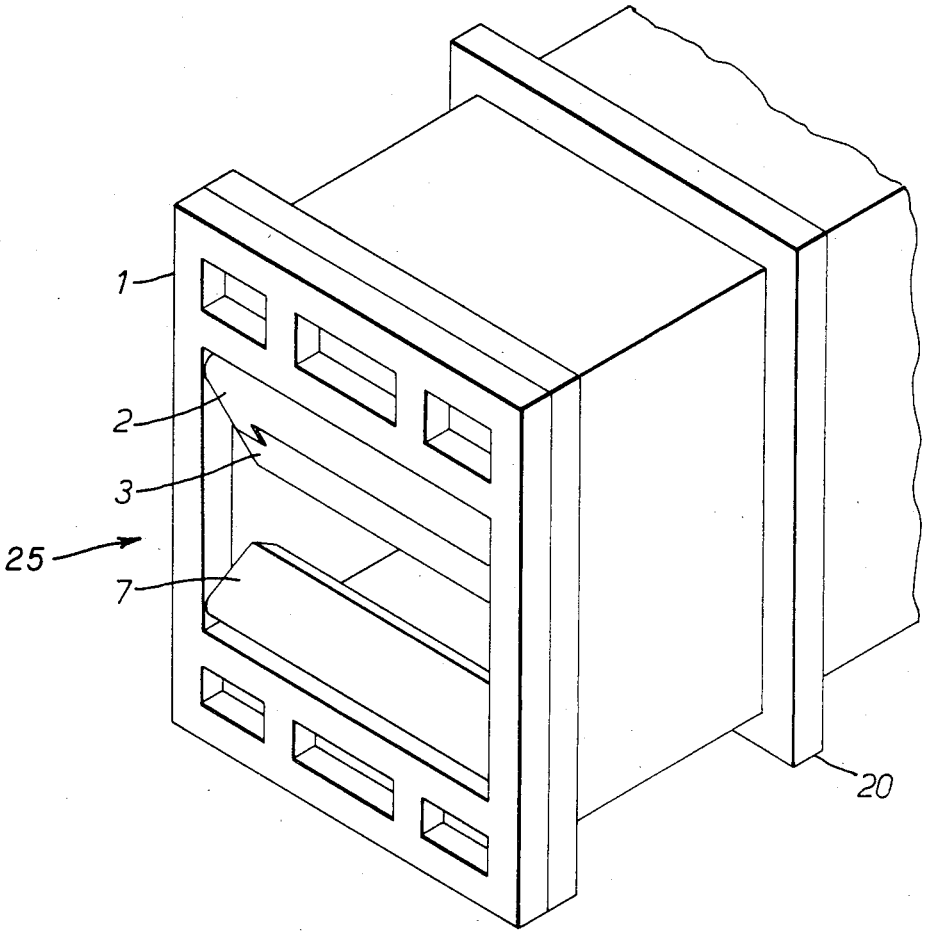
Figure 11:
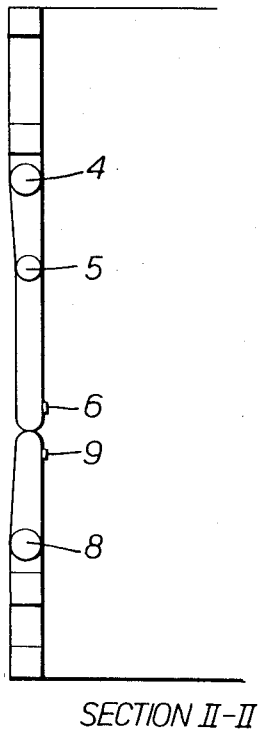
Figure 10:
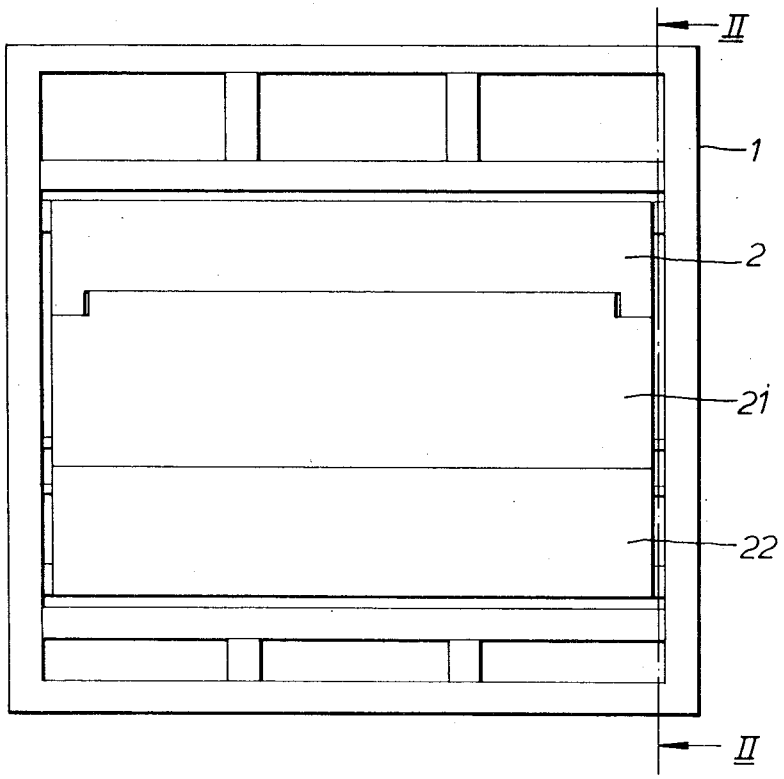
Figure 12:
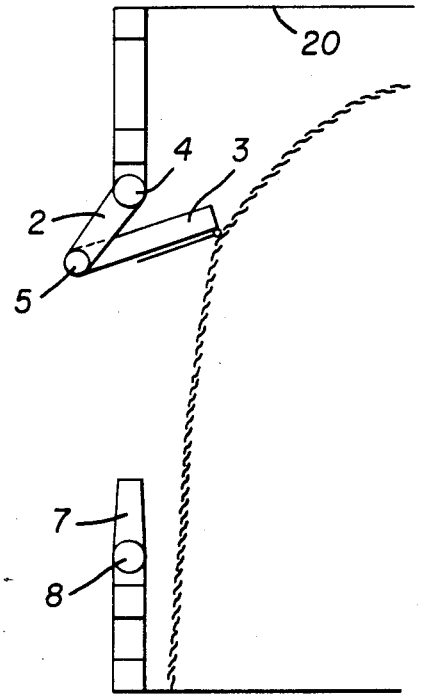

FIG. 2*a* is a fragmentary side view of a hinge of the structure of FIG. 2, FIG. 3, 4, and 5 are a series of three sections corresponding to that shown in FIG. 2 in different operating positions, FIGS. 6, 7, and 8 are a further three sections showing the door open in the fully loaded position of three modified forms of closure, FIG. 9 is a perspective view of the rear end of a container corresponding to FIG. 1 and FIGS. 10 and 11 are views similar to FIGS. 1 and 2 but with a rather larger lower flap intended for use with an extended bottom spigot surface, FIG. 12 is a sectional view similar to FIGS. 2 through 8 and showing the intermediate hinge outside the container after withdrawal of a packer spigot.

Referring first to FIGS. 1, 2, 3 through 5, and 9, a container 20 has a rear door 25 hinged at one side and this door has an opening which matches the spigot 10 of a packer, the remainder of which is not shown since it is conventional. The container 20 is provided with the usual external reinforcements and is designed to be picked up and offloaded by a road vehicle. Again this is conventional and is thought not to require illustration. The opening defined by rear door 25 is effectively filled by a lower flap 7 which is mounted on a horizontal hinge 8 and an upper flap 2 which is mounted on a horizontal hinge 4. The upper flap also has a subsidiary flap 3 articulated to it by means of a hinge 5. Flap 3 includes stops 6 which prevent it from extending outwards of the container. The hinge 8 is provided with a preloaded spring which will maintain the flap 7 normally in a vertical position and this is provided with stops 9 which prevent it from extending outwards of the container. The flap 2 may maintain its vertical position by gravity or this may be assisted by a preloaded spring within the hinge 4 as shown in FIG. 2*a*.

Figures 3, 4, 5:
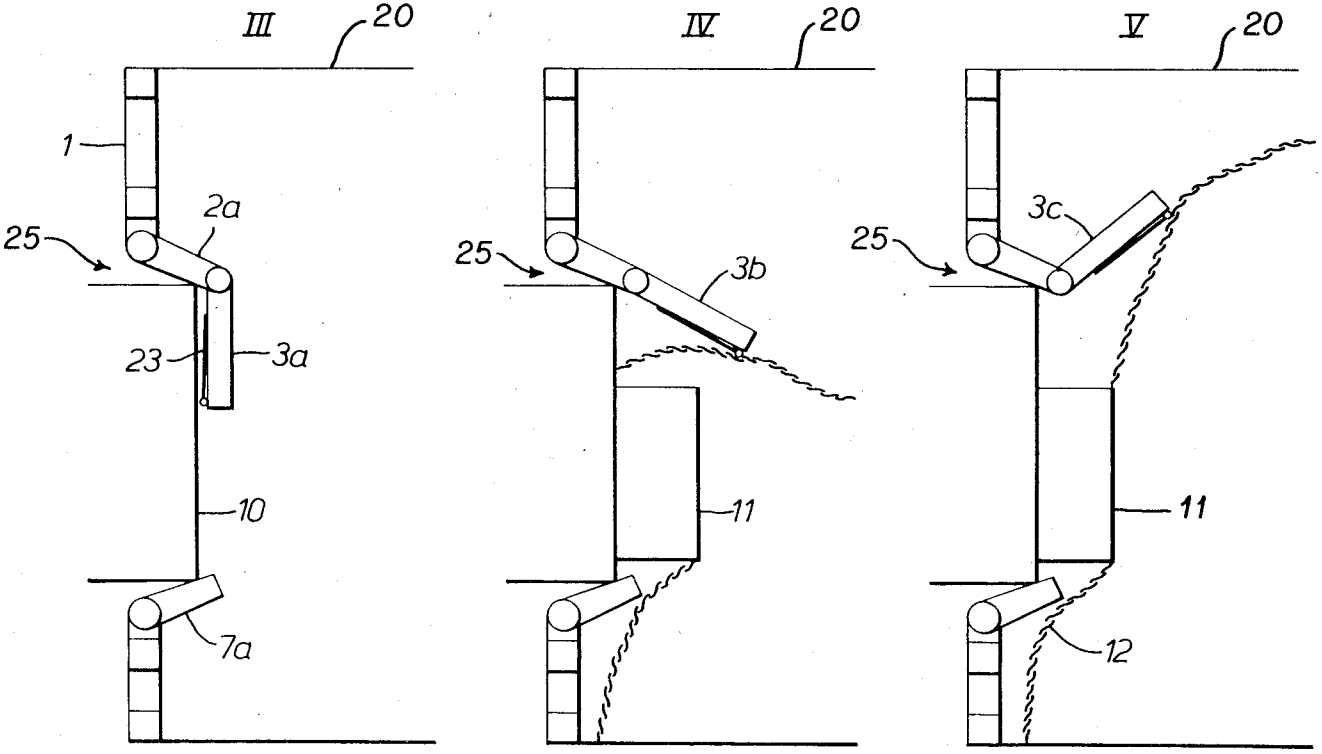

The sequence of operations when a container arrives at the packer is illustrated in FIGS. 3 through 5. The first stage is shown at III where the container has been pushed by the vehicle that brings it to the site in a direction towards the left in the drawing so that the spigot 10 enters the opening at the loading door. This has the effect of pushing the flap 7 into the position shown at 7*a* and pushing the flap 2 into the position shown at 2*a*, while the auxiliary flap 3 occupies the position shown at 3*a*. The next stage is shown at IV and the container is there shown partly filled as a result of the successive operations of the ram 11 which reciprocates from a hopper of the packer to insert waste material into the container. As will be seen this waste material occupies a position at the lower level which approaches rearwardly the lower flap 7 and its upper surface forces the flap 3 into the position shown at 3*b*. The final position is shown at V and in this view the operation of the ram 11 has compacted and inserted further material with the result that it is piled up against the under side of the flap 3 so that it occupies the position shown at 3*c*. During this loading operation it will be appreciated that the contianer has been held attached to the packer by means of the conventional hydraulically operated hooks. These are then released so that the vehicle can pull the container away from the packer, during which operation the flap 7 returns to its normal vertical position. The flap 2 also returns to the vertical and in doing so drags the auxiliary flap 3 over the surface of the compacted material. In order to ensure that the flap 3 is not restrained by the compacted material it is sometimes necessary that the hinge of the flap 2 permits it to rotate to a position outwards of the rear of the door frame. This may be achieved by gravity if there is sufficient mass in the flap 3, or the necessary force may be applied manually.

It will be seen that there is a gap between the bottom edge of the flap 3 and the top edge of the flap 7, and although this is unlikely to allow egress of material it may well be necessary to close this gap in order to satisfy regulations relating to road transport. For this purpose a further flap 23, which may be of less substantial construction, which is folded up into the position 23*a* during the loading operation, may be folded down to close the gap for transport purposes.

The flaps 2, 3 and 7 are constructed of fabricated steel sheet and, as shown in the drawing, are contacted directly by the leading edges of the spigot 10 and the ram 11. However they may be provided with special wearing surfaces at the points of contact and these may be cam shaped, if desired, in order to give the required opening to the flaps.

The construction shown results in a considerable simplification of the operations required to load a container in the circumstances described since no manipulation of the rear door is required, all of the operations being carried out simply as a result of pushing the container into the operating position in relation to the packer where the hydraulically operated hooks of the latter can take effect. It will also be appreciated that a minimum of spillage occurs since the spigot of the packer fits closely into the opening that is closed by the flaps 2, 3 and 7.

FIGS. 6 through 8 shows at VI, VII and VIII three further forms of the invention in which the opening is completely closed by flaps when the container is withdrawn from the spigot. At position VI two flaps 14 are provided which are of equal length and the closed position is shown in broken lines. In the case of these flaps, since they are longer than those previously described, a roller 13 is provided on each in order to reduce the frictional forces involved in opening them by means of the spigot 10. Such rollers can also be provided if desired in the previously described construction, but in that case have generally be found to be unnecessary. At VII flaps 15 and 16 are provided which approximate in depth those of FIG. 1 but the extra length that may be needed to completely close the gap is made up by flexible material portions 17 and 18 of the flaps 15 and 16 respectively. These may be constructed of fabric-reinforced rubber sheet chosen to have a suitable degree of flexibility. The construction shown at VIII employs flaps of the same proportions as those in FIGS. 1 through 5 but in this case the complete closure is achieved by the addition of a flexible extension 19 to the flap 3. This causes a minimum of impedance to withdrawal of the flap 3 over the surface of the compacted material but nevertheless closes the gap when the flaps resume their vertical position.

The dimensions of the upper flap will depend at least in part on the extent to which the container filling approaches the maximum possible load, and this can be determined, and automatically controlled, by a pressure sensitive element applied to the ram or to the hook connection between the packer and the container. FIG. 5 therefore shows a construction for use in situations where less than maximum loading can be tolerated and in this case the flap 2 has articulated to it a subsidary flap 21 the vertical length of which is sufficient to cause it to meet when closed the edge of the lower flap 22.

Although the invention has been described mainly in relation to containers that are brought to the site and removed therefrom by road vehicles, the invention is not limited to such an arrangement, and containers may be handled at the site if desired by purpose-built mechanical handling equipment. In that case the required movement of the containers towards and away from the packer may be effected by the mechanical handling equipment.

We claim:

1. A structure adapted to form part of an end wall of a vehicle transfer container body for carrying and transporting compacted loose material, such as domestic waste, said structure comprising: a container including a container end wall portion having a rectangular opening forming therein for cooperation with a spigot of a horizontally acting packer, said opening having a top, a bottom, opposed sides, and including a pair of inwardly openable upper and lower doors, said upper door being biassed to yieldably maintain it in a closed position and being hinged at the top of said opening, said upper and lower doors arranged to open inwardly by contact with the spigot and on relative movement of the structure theretowards, the upper of the pair of doors having a main portion and a distal portion connected to the main portion and capable of flexing inwardly of said container body along an intermediate horizontal hinge between said main and said distal portions so that when opened inwardly said distal portion can flex upwards to a position corresponding to a forward-sloping surface of loaded material within the container, the closing bias of the upper door being effective, on withdrawal of the spigot, to move said door with the distal portion flexed and moving down over said surface of loaded material first to a position where said intermediate hinge is rotated to a position outside the end wall portion of the container so as to allow the distal edge of the said distal portion to clear the surface of loaded material, whereafter the upper door straightens out to form a closure with said intermediate hinge approximately in the plane of the container end wall portion.

2. A container body according to claim 1 wherein said distal portion has an end portion which adopts an angle with respect to the main portion of said upper door which corresponds, during the time that the upper door is fully open, to the angle of repose of said surface of loaded material.

3. A packer-container combination comprising a container body according to claim 1 and a packer having a spigot including a lower margin which extends beyond an upper margin, and the lower door of the container body extends inwards when opened a distance not more than the penetration of the lower margin.

4. A structure according to claim 1 wherein said distal portion constitutes at least one half of the height of the upper door.

5. A structure according to claim 4 wherein said distal portion has attached to its distal edge a further flexural portion to cooperate with the lower door to completely close said opening.

6. A packer and container combination comprising a container having an end wall constructed according to claim 5 and a packer having a spigot including a lower margin which extends further than an upper margin, and the lower door of the opening extends inwards, when opened, to a distance not greater than the penetration of the said lower margin.

7. A packer and container combination comprising a container having an end wall constructed according to claim 4 and a packer having a spigot including a lower margin which extends further than an upper margin, and the lower door of the opening extends inwards, when opened, to a distance not greater than the penetration of the said lower margin.

8. A structure according to claim 1 wherein said distal portion has attached to its distal edge a further flexural portion to cooperate with the lower door to completely close said opening.

9. A packer and container combination comprising a container having an end wall constructed according to claim 8 and a packer having a spigot including a lower margin which extends further than an upper margin, and the lower door of the opening extends inwards, when opened, to a distance not greater than the penetration of the said lower margin.

10. A packer and container combination comprising a container having an end wall constructed according to claim 1 and a packer having a spigot including a lower margin which extends further than an upper margin, and the lower door of the opening extends inwards, when opened, to a distance not greater than the penetration of the said lower margin.

* * * * *